US007124775B2

(12) United States Patent
Chang

(10) Patent No.: US 7,124,775 B2
(45) Date of Patent: Oct. 24, 2006

(54) MICRO PUMP DEVICE WITH LIQUID TANK

(76) Inventor: Neng-Chao Chang, No. 6, Lane 189, Sec. 2, Chung-Yuan Rd., Tu-Cheng City, Taipei Hsien (TW)

( * ) Notice: Subject to any disclaimer, the term of this patent is extended or adjusted under 35 U.S.C. 154(b) by 233 days.

(21) Appl. No.: 10/358,244

(22) Filed: Feb. 5, 2003

(65) Prior Publication Data

US 2004/0149339 A1 Aug. 5, 2004

(51) Int. Cl.
*F16K 37/00* (2006.01)
*H05K 7/20* (2006.01)

(52) U.S. Cl. ..... 137/559; 137/565.17; 165/80.4; 361/699

(58) Field of Classification Search ..... 137/559, 137/565.17, 565.19, 587; 165/80.4; 361/699; 257/714
See application file for complete search history.

(56) References Cited

U.S. PATENT DOCUMENTS 1,218,300 A * 3/1917 Nelson ..... 418/9
2,171,266 A * 8/1939 Cissell ..... 137/587
2,984,187 A * 5/1961 Prasse et al. ..... 137/565.17
3,515,167 A * 6/1970 Svenson ..... 137/565.17
5,316,077 A * 5/1994 Reichard ..... 361/699
5,336,057 A * 8/1994 Fukuda et al. ..... 417/395
5,518,611 A * 5/1996 Bresolin ..... 210/169
5,692,883 A * 12/1997 Vourc'h ..... 417/312
5,731,954 A * 3/1998 Cheon ..... 165/80.4
6,004,119 A * 12/1999 Hamasaki et al. ..... 418/181
6,234,240 B1 * 5/2001 Cheon ..... 165/80.3
6,484,744 B1 * 11/2002 Tseng ..... 137/205
6,529,377 B1 * 3/2003 Nelson et al. ..... 361/699
2002/0075643 A1 * 6/2002 Nakagawa et al. ..... 361/687
2002/0117291 A1 * 8/2002 Cheon ..... 165/80.4

* cited by examiner

*Primary Examiner*—John Rivell
(74) *Attorney, Agent, or Firm*—Kao H. Lu

(57) ABSTRACT

A micro pump device with liquid tank comprises a liquid tank being made of transparent material; and a micro pump having an inlet positioned in center of the liquid tank and the micro pump locating the side of said liquid tank. And, the liquid tank further includes a first inlet, a second inlet and a vent hole. The pump device provides a cooling system for micro electric device and a liquid tank could provide a closed tank of cooling system.

2 Claims, 4 Drawing Sheets

MICRO PUMP DEVICE WITH LIQUID TANK

BACKGROUND OF THE INVENTION

1. Field of the Invention

The present invention relates to a micro device and more particularly relates to a micro pump with a liquid tank which provides a cooling system for micro electric devices and the liquid tank provides a closed tank cooling system.

2. Description of Related Art

The performance of integrated circuits continue to increase as their size gets smaller. More heat will be generated by high performance ICs and it is hard to remove. The heat could be a factor in the life of the IC. And, a more important device using ICs is the centre processing unit, and conventional removal heat device are not effective at the removal of heat in high speed CPUs. Referring to FIG. 1, the conventional cooling system comprises a pump 20 connected to a liquid tank 30. The Liquid is pumped from liquid tank 30 by an outlet 205 of pump 20 and is led to a cooling system by a pipeline 201. Further, the liquid of the cooling system removes the heat of the CPU and returns to the liquid tank 30 by a pipeline 203. Therefore, the device has many disadvantages, for example: larger liquid tank, more space for liquid tank and non-trasportability of the tank. Furthermore, the top of the liquid tank has an opening which could decrease liquid volume. The CPU may be damaged when the height of liquid in the liquid tank is lower than the outlet 205.

SUMMARY OF THE INVENTION

It is an object of the present invention to provide a micro pump device with liquid tan which has a micro pump with a liquid tank for a micro electron device, for example: CPU, and could not be offered liquid by other device.

It is another object of the present invention to provide a micro pump device with liquid tank which has a liquid tank allowing for adding liquid to maintain the height of liquid in the liquid tank, and an adding liquid inlet of the tank could be sealed to form a closed tank.

It is a further object of the present invention to provide a micro pump device with liquid tank where the micro pump is closely connected to the liquid tank and the inlet pipeline of the pump is disposed in the horizontal centre of the liquid tank. The micro pump device with liquid tank could dispose any direction position (such as vertical position, horizontal position or reverse position) and could not lead the air into the liquid tank.

BRIEF DESCRIPTION OF THE DRAWINGS

The above and further objects, features and advantages of the invention will become clear from the following more detailed description when read with reference to the accompanying drawings in which.

DETAILED DESCRIPTION OF THE PREFERRED EMBODIMENTS

Figure 1:
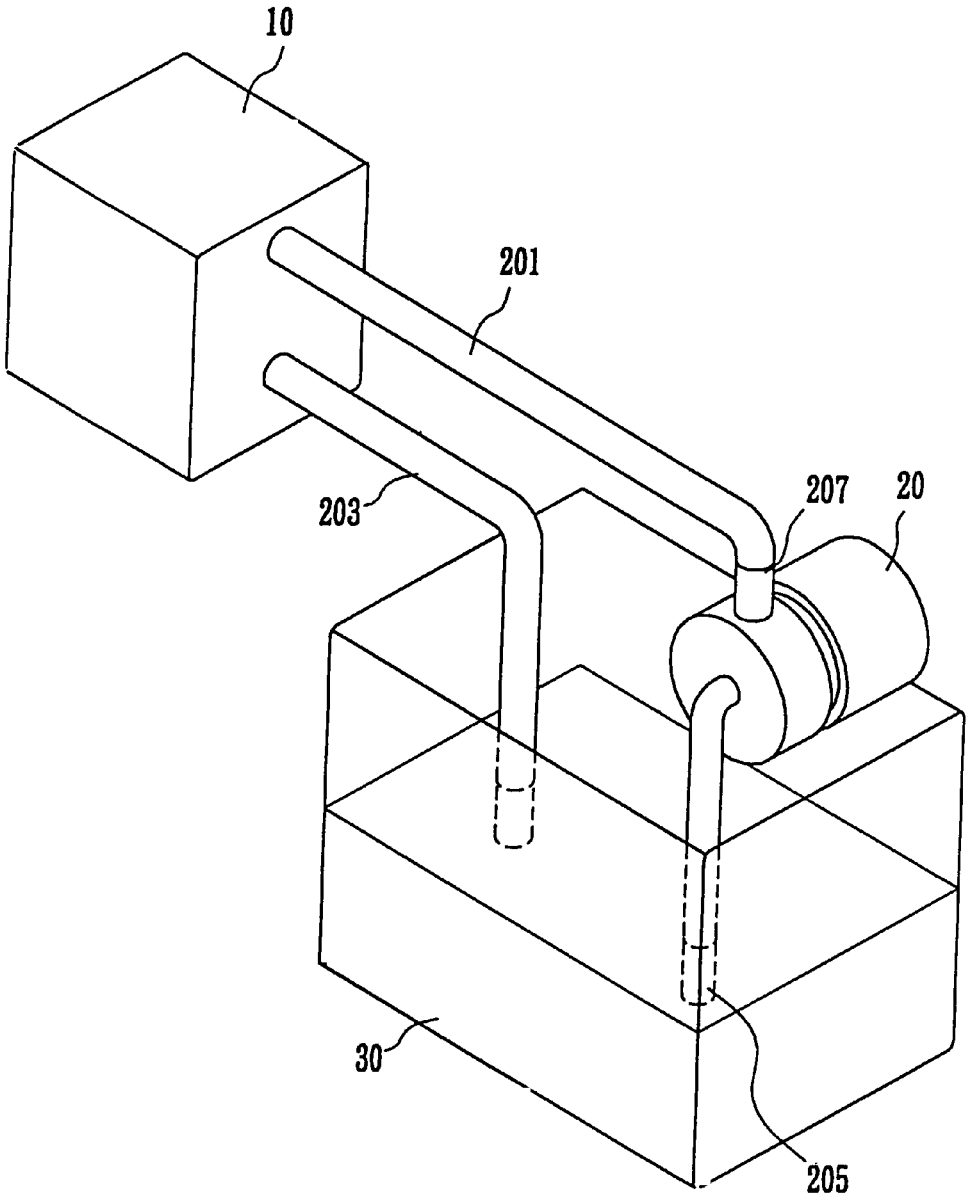
FIG. 1 (Prior Art)
FIG. 1 is an illustrated view of the cooling system of prior art.
Figure 2:
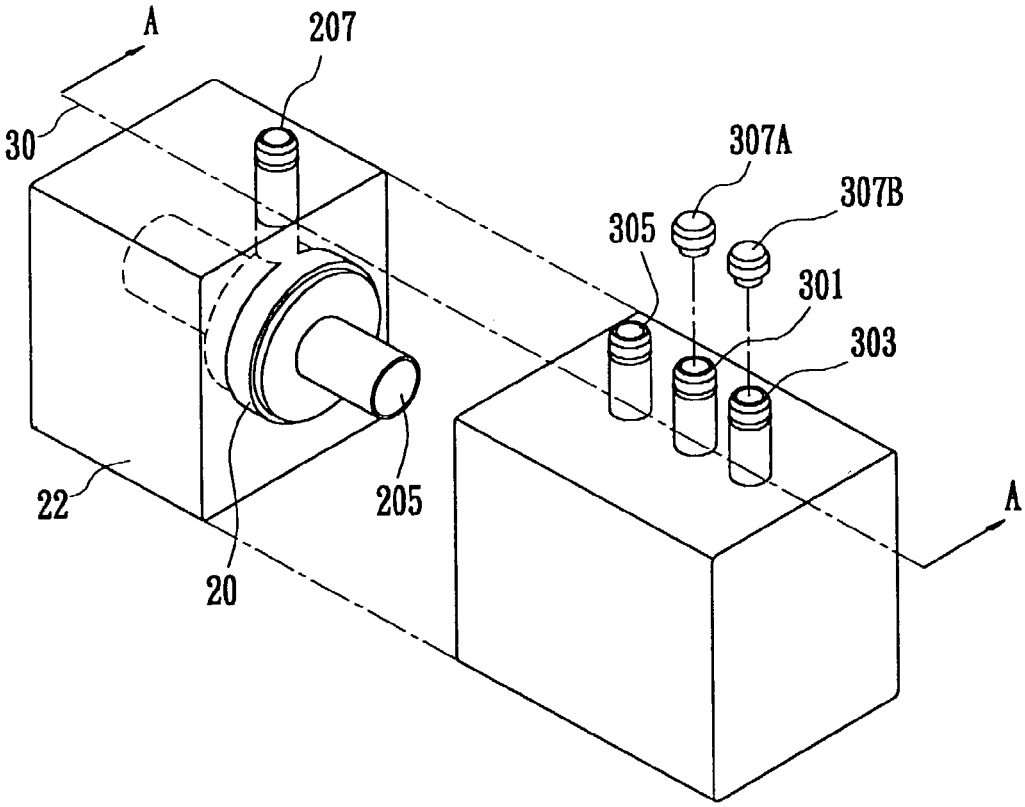
FIG. 2 is a perspective view of the present invention.
Figure 3:
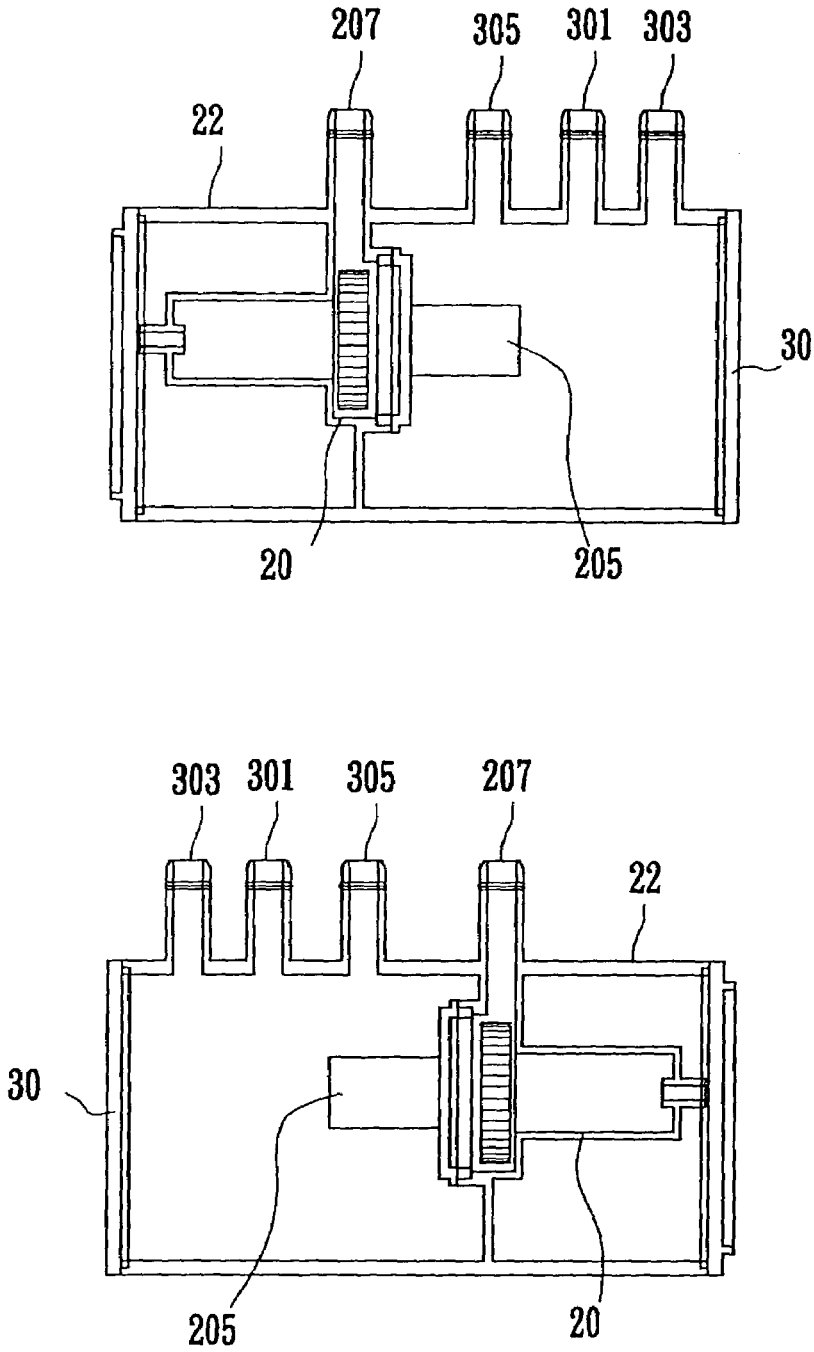
FIG. 3 is a sectional view of the present invention.
Figure 4:
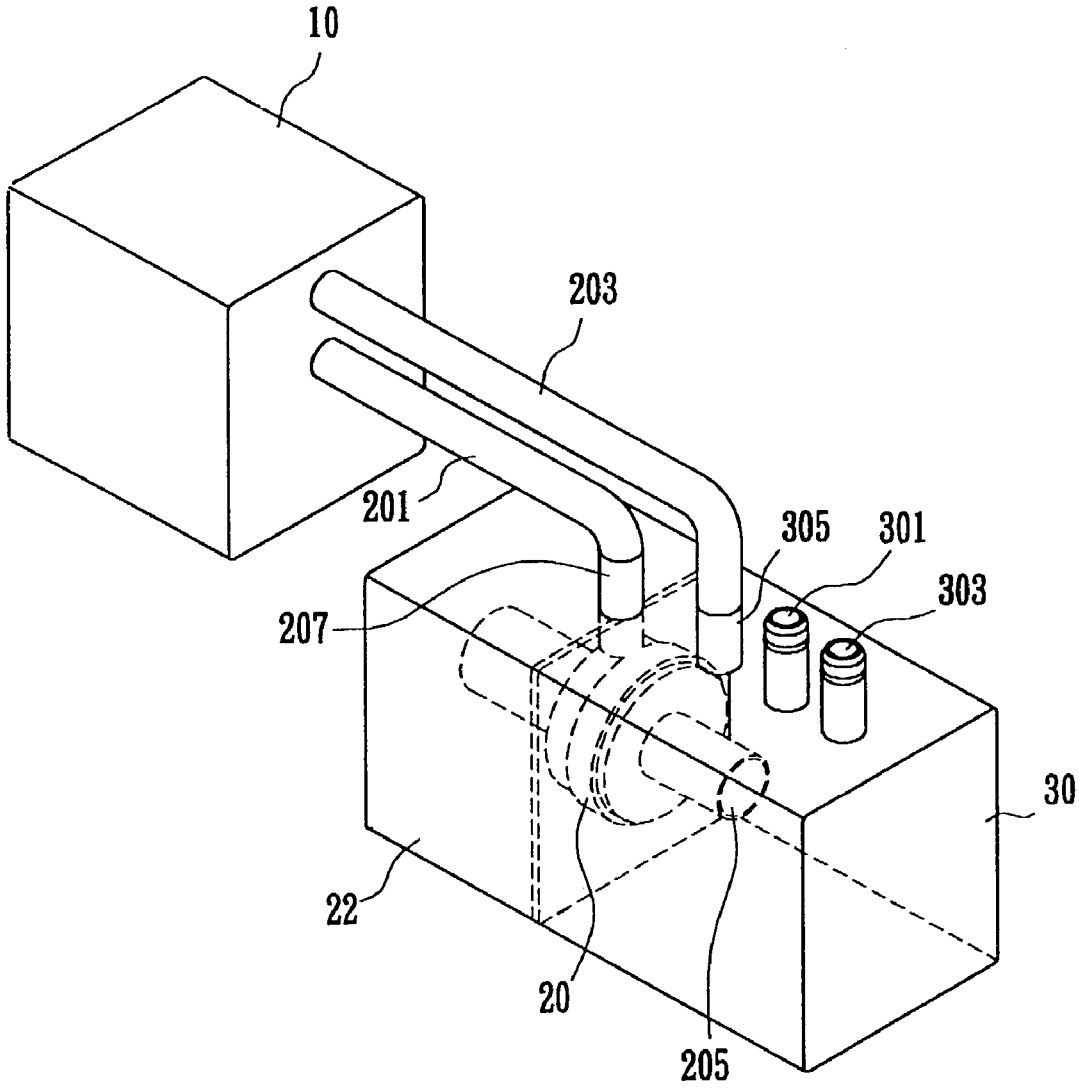
FIG. 4 is an illustrated view of the cooling system of the present invention.

Referring to FIGS. 2 and 3, the present invention discloses a micro pump 20 and a liquid tank 30. The micro pump 20 is covered by a shell 22 and has an inlet 205 which protrudes from a side of shell 22 and extends to the centre of the water tank at the horizontal center of the tank 30 wall. The micro pump 20 has an outlet 207 which protrudes from the top of shell 22 and is coupled to a cooling system 10 by a pipeline 201. The water tank 30 is disposed to the side of pump 20 and is covered by the shell 22. Further, the top of water tank 30 includes a first inlet 305, a second inlet 301 and a vent hole 303 for recycling, adding water and emitting. In addition, the second inlet 301 has a first rubber plug 307A and the vent hole 303 has a second rubber plug 3078 for preventing the liquid from leaking. The first inlet 305 is coupled to the cooling system 10 to from a closed recycling system via pipeline 203 (refer to FIG. 4).

First, removing the rubber plugs 307A and 307B, the liquid tank is filled with liquid by the second inlet 301 and then the second inlet 301 and the vent hole 305 are plugged by rubber plugs 307A and 307B. Starting the micro pump 20, the liquid is guided from water tank 30 through the inlet 205 to the outlet 207. And, the water is guided from outlet 207 to the cooling system 10 by pipeline 201 and absorbs the heat. After absorbing heat, the water flows to the second inlet 305 of liquid tank 30 by pipeline 203 and flows into the water tank 30. After the liquid is recycled, the plugs 307A and 307B are removed from the liquid tank 30 and the liquid tank 30 is refilled with liquid and is plugged by plugs 307A and 307B to form a closed system.

The liquid of the liquid tank 30 is decreased in volume by attaching many air bubbles on an inside wall of pipelines 201 and 203, inside cooling system 10 or on the inside wall of micro pump 20. Therefore, the present invention discloses the second inlet 301 and vent hole 303 for adding liquid and emitting air.

The present invention has a major advantage in the form of the inlet 205 of micro pump 20 being disposed in the centre of the liquid tank 30 and forming a closed system. Furthermore, the pump with liquid tank is a closed system and the pump can not be damaged in the process of venting and removal of air.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A micro pump device with a liquid tank for cooling heat generating electrical circuit components comprising:

a liquid tank being made of transparent material;

a supporting structure being located about the horizontal center of the liquid tank; and a micro pump having an inlet supported by the supporting structure and positioned in the center of said liquid tank, where in said liquid tank further includes a first inlet, a second inlet and a vent hole for venting gas.

2. The micro pump device claimed in claim 1, wherein the supporting structure comprises a wall.

* * * * *